US005862932A

United States Patent [19]

Walsh et al.

[11] Patent Number: 5,862,932

[45] Date of Patent: Jan. 26, 1999

[54] PORTABLE COLLAPSIBLE GARBAGE CAN

[76] Inventors: Carolyn Walsh; Gary Wright, both of 866 Main St. East, Hamilton, Canada, L8M 1L9

[21] Appl. No.: 984,665

[22] Filed: Dec. 3, 1997

Related U.S. Application Data

[60] Provisional application No. 60/032,082, Dec. 3, 1996.

[51] Int. Cl.[6] ..... B65D 6/24

[52] U.S. Cl. ..... 220/8; 220/666; 220/484; 220/908

[58] Field of Search ..... 220/8, 666, 484, 220/908

[56] References Cited

U.S. PATENT DOCUMENTS

| | | | |
|---|---|---|---|
| 2,764,545 | 9/1956 | Primich | 220/8 |
| 2,827,004 | 3/1958 | Luce et al. | 220/8 |
| 3,285,459 | 11/1966 | Gahm | 220/8 |
| 3,329,298 | 7/1967 | Demas | 220/8 |
| 4,142,537 | 3/1979 | Fenelon | 220/8 |
| 4,442,567 | 4/1984 | Pravettone | 15/257.4 |
| 4,457,483 | 7/1984 | Gagne | 248/97 |
| 4,513,938 | 4/1985 | Seymore | 248/507 |
| 4,574,969 | 3/1986 | Mays | 220/8 |
| 4,624,382 | 11/1986 | Tontarelli | 220/8 |
| 4,973,189 | 11/1990 | Bechtold | 220/8 |
| 4,978,021 | 12/1990 | Mini et al. | 220/8 |
| 5,056,679 | 10/1991 | Lonczak | 220/404 |
| 5,101,996 | 4/1992 | Mosley | 220/8 |
| 5,183,228 | 2/1993 | Curry | 248/100 |
| 5,397,011 | 3/1995 | Schafer et al. | 220/4.22 |
| 5,690,249 | 11/1997 | Karlsten | 220/666 |

*Primary Examiner*—Joseph M. Moy

[57] ABSTRACT

A portable collapsible garbage can has a central vertical axis and inner and outer sides and concentrically adjacently spaced substantially vertically oriented annular flat wall panels. Each wall panel has upper and lower distal ends and there is an innermost and outermost wall panel. The wall panels are concentrically oriented about the vertical axis and can be vertically telescopically raised and lowered between an extended and a retracted position. In the extended position the panels partially overlap along the vertical axis and define a garbage compartment having an open top and bottom. In the retracted position the panels are concentrically nested adjacent each other and overlapped along the vertical axis.

11 Claims, 4 Drawing Sheets

Figure 3
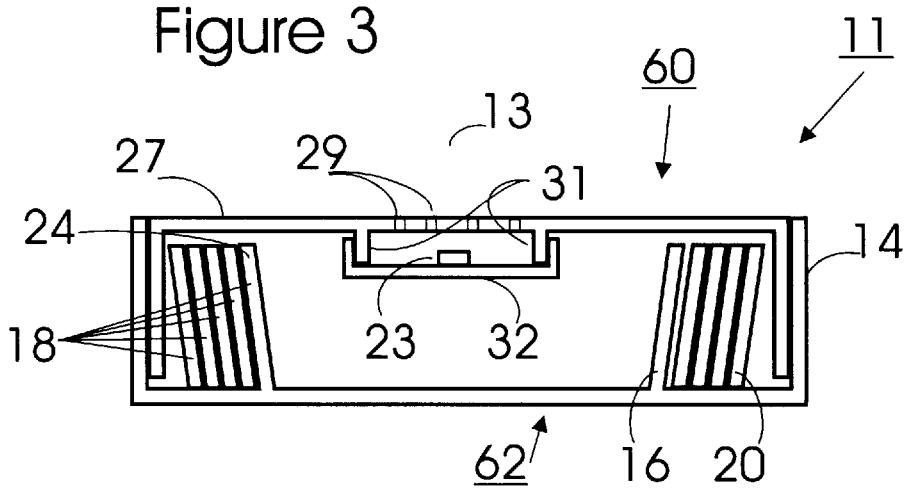
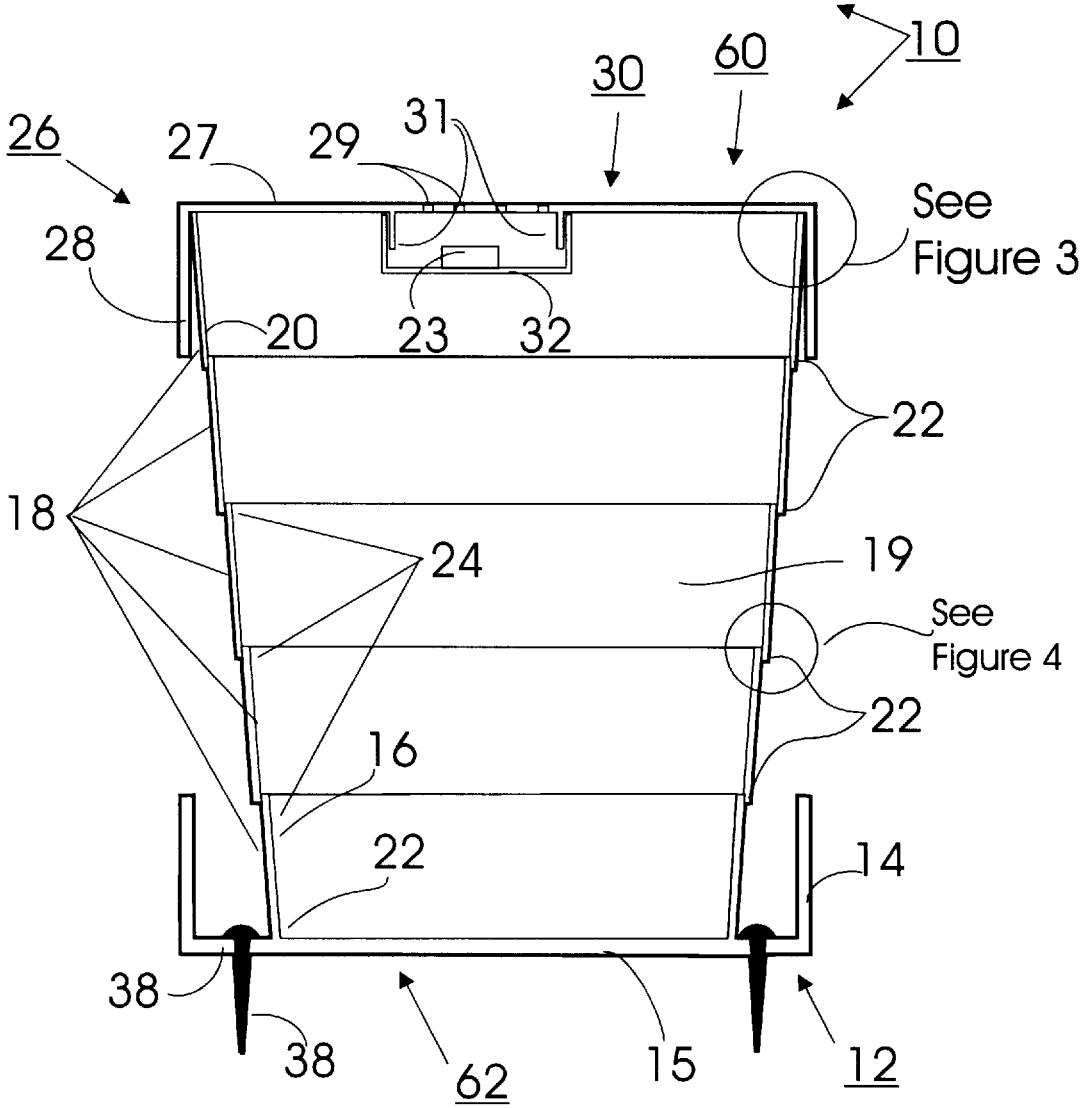
Figure 2

PORTABLE COLLAPSIBLE GARBAGE CAN

CROSS REFERENCE TO RELATED APPLICATION

This application repeats a substantial portion of prior provisional patent application No.: 60/032,082 and adds and claims additional disclosure not presented in the prior application.

FIELD OF THE INVENTION

This invention relates in general to containers and more particularly to garbage containers which are collapsible and portable.

BACKGROUND OF THE INVENTION

Conventional garbage or trash cans are fabricated from metal or synthetic plastic materials and are designed to withstand rough handling. The common practice is to line garbage cans with plastic trash bags when refuse to be collected in the cans is in the form of food waste or other substances which tend to stick to or smear the inner surface of the garbage can. The bag is of sufficient strength so that when filled, it may be tied and then removed from the can and discarded.

Conventional metal or plastic garbage cans are not foldable or collapsible and they occupy a substantial amount of space. The portability and collapsibility of conventional garbage cans is not an issue since they usually remain in one location for the life of the container.

Garbage collection is often required in the outdoors and locations away from the home or where there is regular garbage collection. Campers for example, often need to collect the garbage they produce at their campsite in their own garbage containers. In these circumstances a portable collapsible garbage can that is animal proof is desirable. Campers preferably would like to be able to transport their garbage containers with them to the campsite.

A number of prior art devices have attempted to produce a collapsible portable garbage can, for example: U.S. Pat. No. 5,056,679, Oct. 15, 1991 entitled Refuse Container Assembly by John Lonczak, and U.S. Pat. No. 4,457,483, Jul. 3, 1984, entitled Collapsible Support for Garbage Bags by Laurat Gagne. These garbage cans although portable and collapsible fail to address the problem of being animal proof and generally sealable so as to prevent odours from being released from the garbage can and/or animals from entering and disturbing the contents of the garbage can. One can appreciate that for campers and outdoor[s] applications being able to seal the container is an important function of a collapsible portable outdoor refuse garbage can.

Accordingly, there is a need for a garbage can which can be easily transported and moved to an outdoor location where garbage collection is required and which overcomes the prior art's shortcomings. This is particularly useful for campers, picnickers, outdoors men and other activities away from the home. It is also desirable that the container be sealable to prevent odours escaping and animals entering into the garbage can.

SUMMARY OF THE INVENTION

A portable collapsible garbage can having a central vertical axis and inner and outer sides, the garbage can comprising concentrically adjacently spaced and substantially vertically oriented annular flat wall panels. Each panel has an upper and lower distal end, there is also an innermost and outermost panel. The panels are concentrically oriented about the vertical axis and have an extending and a retracting means for vertically telescopically raising and lowering the panels between an extended and a retracted position. In the extended position the panels partially overlap along the vertical axis, and in the retracted position the panels are nested adjacent each other and overlapped along the vertical axis. The garbage can further comprises a locking means for maintaining the panels in the extended position.

The portable collapsible garbage can further preferably comprises a flat substantially horizontal base rigidly connected to the lower distal end of the innermost panel base for supporting the lower distal ends of the panels in the retracted position.

The extending means preferably comprises upwardly slidably urging the outer most panel thereby consecutively raising each wall panel by engaging the locking means with adjacent panels until all panels are locked in the extended position.

The retracting means preferably comprises downwardly urging the upper most panels disengaging the locking means with adjacent panels until all panels are unlocked and in the retracted position.

The locking means preferably comprises a rib and a co-operating recess near the distal ends of the adjacent panels, such that the rib on one panel engages with the recess on an adjacent panel when the garbage can is in the extended position.

The portable collapsible garbage can further preferably comprises a flat lid being releasably securable to the outer most panel.

BRIEF DESCRIPTION OF THE DRAWINGS

The invention will now be described by way of example only, with references to the following drawings in which:

FIG. 2 is a schematic side cross sectional side elevational view of the collapsible portable garbage can in its extended position.

FIG. 3 is a schematic cross sectional side elevational view of the collapsible portable garbage can in its retracted position.

DETAILED DESCRIPTION OF THE PREFERRED EMBODIMENT

Definition: "Annular" in this patent includes shapes other than circular such as square, hexagonal, triangular etc.

Figure 1:
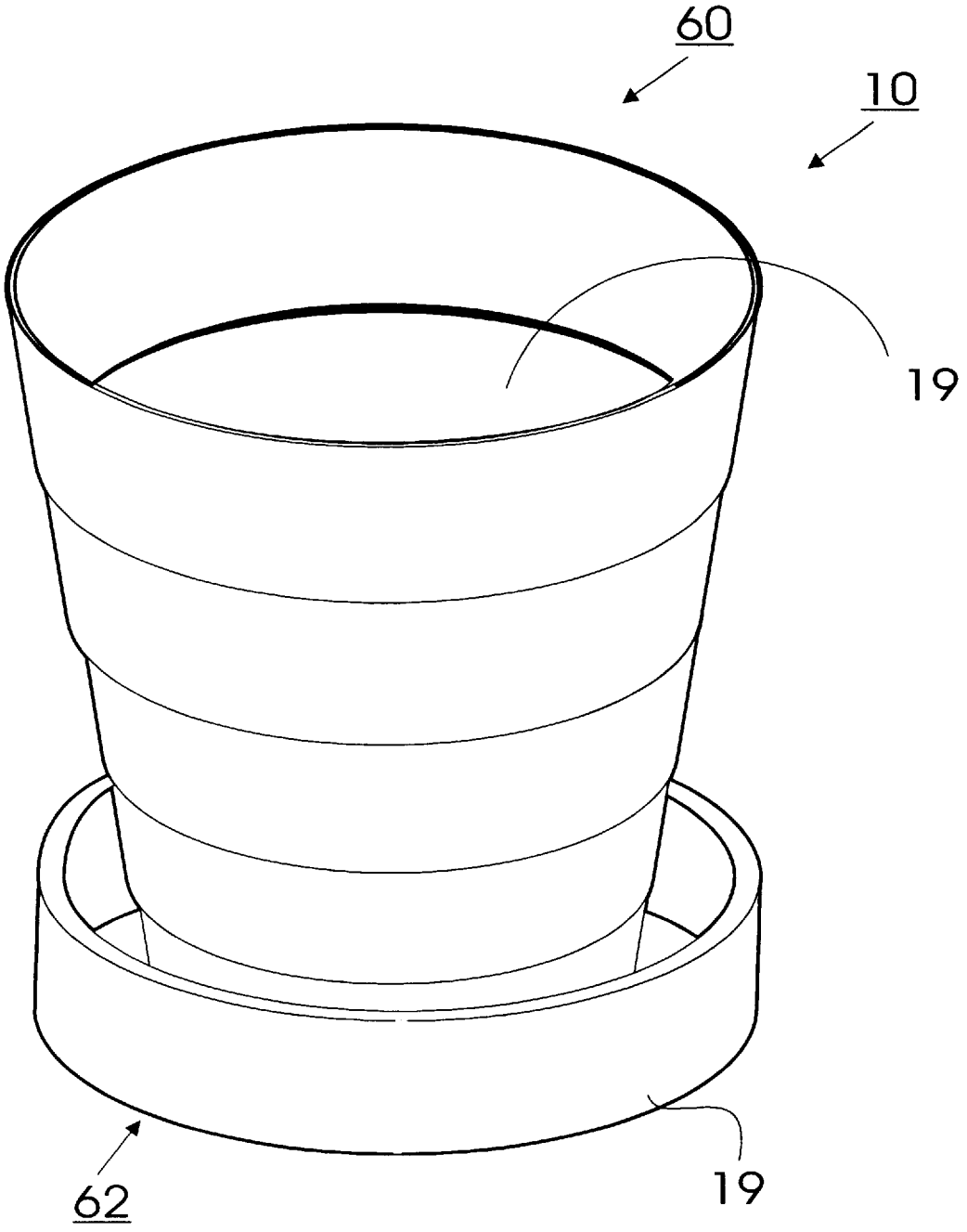
FIG. 1 is a schematic perspective elevational view of the collapsible portable garbage can in its extended position without a lid.

FIG. 1 illustrates a preferred embodiment of the present invention a collapsible portable garbage can shown generally as 10 in the extended position. The embodiment depicted is telescopically cylindrical in shape and shown with a base 12, central vertical axis 13, and without a lid.

Referring now to FIGS. 2 and 3 the subject collapsible portable garbage can 10 comprises a base 12, wall panels 18 lid 26, a top 60 and bottom 62.

The subject collapsible portable garbage can 10 further comprises a base 12 having a base bottom 15 and a base flange 14 which extends vertically upwards from the periphery of base bottom 15. Lower distal end 22 of innermost wall panel 16 is shown rigidly connected to base 12. Wall panels 18 are concentrically adjacently spaced, substantially vertically oriented flat cylindrical wall panels. Wall panels 18 are dimensioned and positioned to telescopically slide relative each other from an extended position shown in FIG. 2 to a collapsed position shown in FIG. 3. In the extended position lower distal end 22 of panel 18 releasably locks with upper distal end 24 of another adjacent wall panel 18. Lid 26 comprises lid flange 28 which is rigidly connected and extends vertically downward from around the periphery of a horizontal lid top 27. The outermost wall panel 20 is releasably securably attached to lid flange 28 via a single thick acme thread. A storage compartment shown generally as 30 has storage compartment side 31 and a storage compartment lid 32 shown releasably locked onto storage compartment side 31. The storage compartment 30 can be any shape such as square or circular.

Base 12 preferably comprises apertures 36 adapted to receive hold down pegs 38 which are driven into the ground for securing collapsible garbage can 10 in a desired location. The hold down pegs may be single straight spikes or U shaped spikes or any type of hold down peg known in the art.

Optionally a repelling scent 23 may be placed in storage compartment 30 or in some other suitable location which has ventilation holes 29 defined in lid top 27 for allowing scent 23 to disperse into the air surrounding the garbage can 10 thereby deterring animals from entering garbage can 10.

Figure 4:
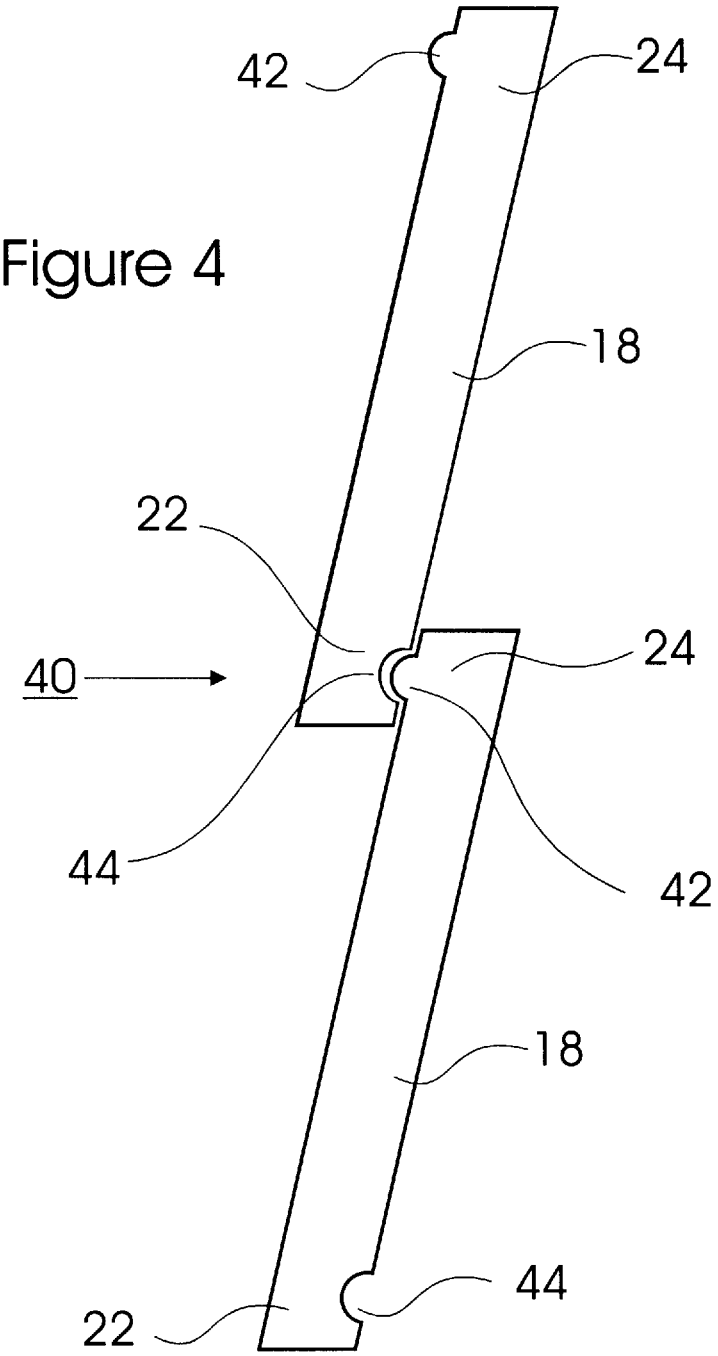
FIG. 4 is an enlarged cross sectional view of the detail circled in FIG. 2 showing two wall panels in the locked extended position.

Referring now to FIG. 4, which is an enlarged view of the detail circled in FIG. 2, shows wall panels 18 in the extended position. Locking means shown generally as 40 comprises a locking rib 42 at upper distal end 24 of wall panel 18 and a cooperating locking recess 44 located at lower distal end 22 of wall panel 18. Urging one wall panel 18 relative to the other engages or disengages locking means 40. Locking means 40 may also be of other configurations known in the art such as tongue and groove, or thread and is not limited to the locking geometry or method depicted.

Figure 5:
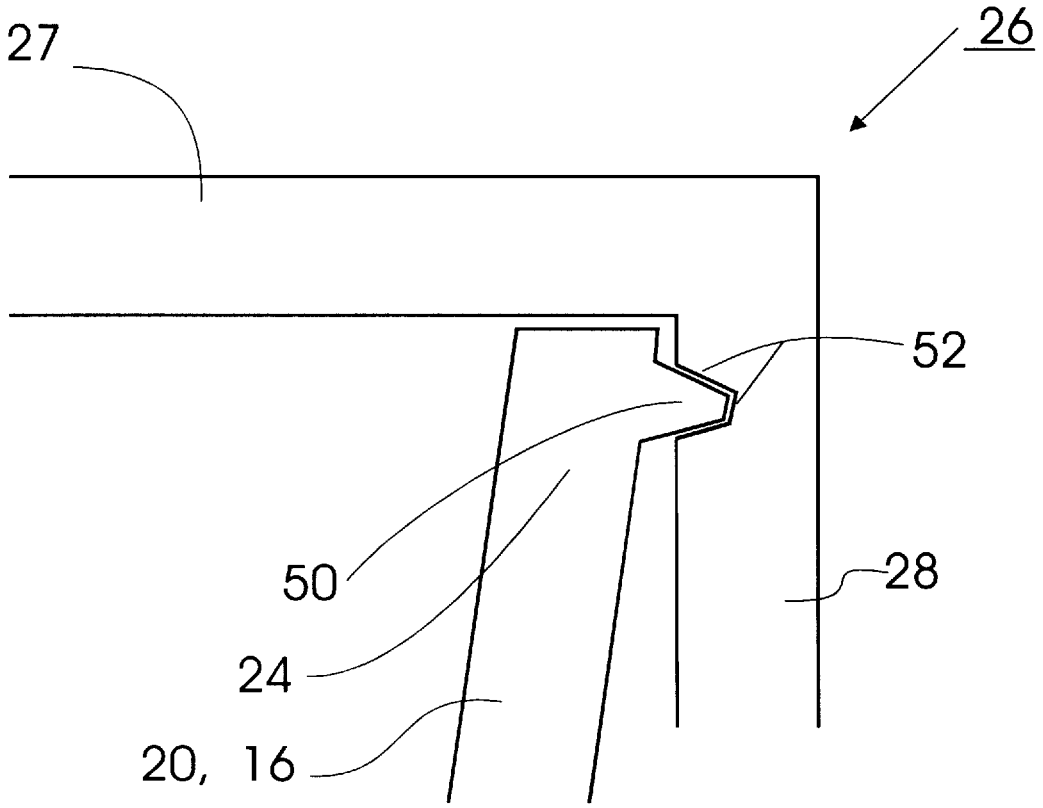
FIG. 5 is a schematic cross sectional side view of the detail circled in FIG. 2 showing the lid locked with the outermost wall panel.

Referring now to FIG. 5 which shows enlarged the detail circled in FIG. 2, outermost wall panel 20 at upper distal end 24 has a single thick acme thread 50 which cooperates with and screws into a receiving thread 52 in lid flange 28 which is rigidly connected to lid 26.

In use, collapsible portable garbage can 10 can be easily transported in a car or other vehicle in the retracted position 11 shown in FIG. 3. Referring now to FIG. 2, the present invention can be extended from retracted position 11 by upwardly urging lid 26 which is connected to outermost wall panel 20 by acme thread 50 thereby upwardly slidably urging outermost panel 20 engaging locking means 40 with adjacent wall panel 18 which in turn upwardly slidably urges the next wall panel 18 and so forth until all wall panels 18 are locked in the extended position as shown in FIG. 2. In the extended position shown in FIG. 2 the wall panels 18 define a garbage compartment 19 which can be used to store garbage. It is also possible to partially extend collapsible portable garbage can 10 by locking, in the extended position, only some of the wall panels 18. It is also possible to extend and retract collapsible portable garbage can 10 with lid 26 removed by upwardly urging on wall panels 18 instead of lid 26.

In the extended position lid 26 can be removed from outermost panel 20 by turning lid 26 counterclockwise approximately one turn. With the lid removed storage compartment lid 32 can be removed from storage compartment 30 for access to storage compartment 30. Storage compartment 30 can be used to store plastic garbage bags or any other devices which may be accommodated by storage compartment 30. Collapsible portable garbage can 10 can be collapsed to retracted position 11 from the extended position shown in FIG. 2 by downwardly urging on lid 26 or on uppermost panel 20 thereby disengaging locking means 40 with adjacent wall panel 18 and continuing downwardly urging until all wall panels 18 are unlocked and in the retracted position 11.

It will be apparent to those skilled in the art that different variations are possible, for example, any number of wall panels 18 of various dimensions can be used to attain variations in height. For example, it is possible to have a collapsible portable garbage can 10 with two wall panels 18. It is also possible to use different locking means 40 for example, tongue and groove and/or threaded mechanisms would also be possible without departing from the spirit of the invention. It will also be apparent that the cross sectional shape of the container need not necessarily be circular but may also be square, triangular or any other shape. The storage compartment can also be made in any convenient size and shape for storing for example garbage bags and other accessories.

Note that the term "wall panel" and "panel" are used interchangeably with both terms having the same meaning.

It should be apparent to those skilled in the art that various modifications and adaptations of this structure described above are possible without departure from the spirit of the invention, the scope of which is defined in the appended claim.

We claim:

1. A portable collapsible garbage can having a central vertical axis and inner and outer sides, the garbage can comprising:

a) concentrically adjacently spaced substantially vertically oriented annular flat wall panels, each panel having upper and lower distal ends, there being an innermost and outermost panel, the wall panels being concentrically oriented about the vertical axis and having extending and retracting means for vertically telescopically raising and lowering the panels between an extended and a retracted position such that in the extended position the panels partially overlap along the vertical axis, the panels defining a garbage compartment having an open top and bottom and in the retracted position the panels are concentrically nested adjacent each other and overlapped along the vertical axis; and b) a locking means for maintaining the panels in the extended position;

c) a horizontal base bottom and a vertically upwardly extending base flange rigidly connected to the periphery of the base bottom and dimensioned to receive and to completely overlap the nested wall panels along the vertical axis in the retracted position, wherein the base further comprises an anchoring means for securing the garbage can into the ground in a desired location, wherein the base is rigidly connected to the lower distal end of the innermost panel for supporting the lower distal ends of the wall panels in the retracted position.

2. The apparatus defined in claim 1, wherein the anchoring means further comprises apertures in the base adapted to receive hold down pegs which are driven through the apertures and into the ground for securing the garbage can in a desired location.

3. The apparatus defined in claim 2, wherein the garbage can further comprises a flat lid being releasably securable to the outer most wall panel, wherein the lid further comprises a lid top having an inner and outer side and a vertically downwardly extending lid flange rigidly connected to the periphery of the lid top and dimensioned to completely overlap the nested wall panels along the vertical axis when in the retracted position.

4. The apparatus defined in claim 3, wherein the outer most panel has a single screw thread dimensioned to co-operate with a screw thread in the lid, thereby releasably locking the lid to the outer most wall panel, such that the lid prevents animals entering the garbage can.

5. The apparatus defined in claim 4, wherein the lid further comprises a storage compartment attached to the inner side of the lid.

6. The portable collapsible garbage can defined in claim 5 comprising a scent carried within the storage compartment, the storage compartment having ventilation holes for allowing the scent to disperse into the air surrounding the garbage can thereby deterring animals from entering the garbage can.

7. The apparatus defined in claim 6, wherein the extending means comprises upwardly slidably urging the outer most panel consecutively raising each wall panel by engaging the locking means with adjacent panels until all wall panels are locked in the extended position.

8. The apparatus defined in claim 7, wherein the retracting means comprises downwardly urging the wall panels disengaging the locking means with adjacent wall panels until all wall panels are unlocked and in the retracted position.

9. The apparatus defined in claim 8, wherein the locking means comprises a rib and a co-operating recess near the distal ends of the adjacent panels, such that the rib on one panel engages with the recess on an adjacent panel when the wall panels of the garbage can are in the extended position.

10. The apparatus defined in claim 9, wherein the base further comprises a horizontal base bottom and a vertically upwardly extending base flange rigidly connected to the periphery of the base bottom and dimensioned to receive and to completely overlap the nested wall panels along the vertical axis in the retracted position.

11. The apparatus defined in claim 10, wherein the flat wall panels are cylinder shaped sections.

* * * * *